US009341178B1

(12) United States Patent
Williams

(10) Patent No.: US 9,341,178 B1
(45) Date of Patent: May 17, 2016

(54) ENERGY OPTIMIZATION FOR VARIABLE SPEED PUMPS

(76) Inventor: Lincoln Williams, Lincoln, NE (US)

( * ) Notice: Subject to any disclaimer, the term of this patent is extended or adjusted under 35 U.S.C. 154(b) by 837 days.

(21) Appl. No.: 13/191,405

(22) Filed: Jul. 26, 2011

Related U.S. Application Data

(60) Provisional application No. 61/367,604, filed on Jul. 26, 2010.

(51) Int. Cl.
*F04B 49/20* (2006.01)
*F04D 13/06* (2006.01)
*F04D 15/00* (2006.01)

(52) U.S. Cl.
CPC ..... *F04B 49/20* (2013.01); *F04D 13/06* (2013.01); *F04D 15/0066* (2013.01)

(58) Field of Classification Search
CPC ..... F04B 49/20; F04D 13/06; F04D 15/0066
USPC ..... 417/42, 43, 44.1, 18, 20, 22; 700/282; 702/182, 183
See application file for complete search history.

(56) References Cited

U.S. PATENT DOCUMENTS 6,076,367 A 6/2000 Sandofsky et al.
6,709,241 B2 3/2004 Sabini et al.
7,050,873 B1 5/2006 Discenzo
7,117,120 B2 10/2006 Beck et al.
7,668,694 B2 * 2/2010 Anderson et al. ..... 702/182
7,686,589 B2 3/2010 Stiles, Jr. et al.
7,707,125 B2 4/2010 Haji-Valizadeh
2007/0154322 A1 7/2007 Stiles, Jr. et al.
2007/0212230 A1 9/2007 Stavale et al.
2008/0067116 A1 * 3/2008 Anderson et al. ..... 210/100
2008/0288115 A1 11/2008 Rusnak et al.

OTHER PUBLICATIONS

Zhenjun Ma, Shengwei Wang; Energy efficient control of variable speed pumps in complex building central air-conditioning systems; Energy and Buildings; 2009; 197-205.
Cameron L. Smith; Energy Efficient Operation of Submersible Borehole Water Pumps Using Electrical Variable Speed Drives; MSc: Sustainable Engineering—Energy Systems and the Environment; University of Strathclyde; 2001-2002.

* cited by examiner

*Primary Examiner* — Patrick Hamo
(74) *Attorney, Agent, or Firm* — David H. Milligan

(57) ABSTRACT

A system includes a pump for connecting to a fluid source. The system also includes an adjustable-speed drive coupled with the pump. The system further includes a flow meter coupled with the pump. The system also includes a processor coupled with the adjustable-speed drive and the flow meter for receiving an approximately instantaneous power consumption and an approximately instantaneous pumping rate. The processor is configured to select an optimal pumping rate for operating the pump based upon a comparison of metrics representing approximately instantaneous pumping rates and approximately instantaneous power consumptions.

6 Claims, 2 Drawing Sheets

ENERGY OPTIMIZATION FOR VARIABLE SPEED PUMPS

CROSS-REFERENCE TO RELATED APPLICATIONS

The present application claims the benefit of 35 U.S.C. §119(e) of U.S. Provisional Application Ser. No. 61/367,604, filed Jul. 26, 2010, and titled "Method of Energy Optimization for Variable Speed Pumps," which is herein incorporated by reference in its entirety.

BACKGROUND

Variable speed pumps have been used in a variety of applications where the ability to adjust the speed of the pump can be used to achieve a constant volumetric flow rate in the face of variations in upstream and downstream pressures and loads.

SUMMARY

A system includes a pump for connecting to a fluid source for transporting fluid. The system also includes an adjustable-speed drive coupled with the pump for driving the pump at a plurality of pumping rates. The system further includes a flow meter coupled with the pump for determining an approximately instantaneous pumping rate of the pump. The system also includes a processor coupled with the adjustable-speed drive and the flow meter for receiving an approximately instantaneous power consumption and an approximately instantaneous pumping rate, where the processor is configured to control the adjustable-speed drive to selectively operate the pump at a pumping rate selected from the plurality of pumping rates. The system further includes control programming configured to associate a first approximately instantaneous pumping rate with a first approximately instantaneous power consumption for a first time interval, and to associate a second approximately instantaneous pumping rate with a second approximately instantaneous power consumption for a second time interval, where the control programming is configured to select an optimal pumping rate for operating the pump based upon the comparison of a first metric representing the first approximately instantaneous pumping rate and the first approximately instantaneous power consumption and a second metric representing the second approximately instantaneous pumping rate and the second approximately instantaneous power consumption.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

Variable speed pumps have been used in a variety of applications where the ability to adjust the speed of the pump can be used to achieve a constant volumetric flow rate in the face of variations in upstream and downstream pressures and loads. However, there is a need to optimize the speed of a pump to achieve the most possible gallons per kilowatt (gal/kW) on a pump curve in applications where a fixed volume of fluid must be pumped over an indeterminate period of time. Such applications include well pumps which may be used to refill a reservoir or tank over an extended period of time.

Accordingly, a system and methods are provided for manipulating the speed of a variable speed pump to achieve the greatest gallons per kilowatt (gal/kW). An adjustable-speed drive, such as a Variable Frequency Drive (VFD), is used to control the speed of the pump. Based on the suction head, the discharge head, and other dynamic factors, the pump may require a different power input all along the pump curve. The flow may not change linearly as the power consumption does along the pump curve, resulting in a difference in gallons pumped per kilowatt consumed.

Since many pumping systems require moving a certain amount of gallons over an uncertain period of time, these pumps can be slowed to pump at the optimum place on the curve. Although the flow rate will be less, and the pump will have to run longer, the overall consumption of power may be less, resulting in significant savings.

In one instance, a Programmable Logic Controller (PLC) may be used with the present disclosure. A signal can be supplied to the PLC from a flow meter to give the flow rate. The PLC communicates with the VFD (or another external device for monitoring power consumption of a motor) to get the instantaneous power consumption. The PLC then automatically manipulates the speed of the drive to find the greatest gallons per kilowatt (gal/kW).

In this manner, the speed of an adjustable-speed drive on a pump can be optimized to achieve the most gallons pumped per kilowatt hour consumed. The system can use the present (approximately instantaneous) flow rate and a reading of the present (approximately instantaneous) power consumption to determine the gallons pumped per kilowatt consumed. The system can continually adjust the speed of the pump until a speed is found that provides a maximized gallons per kilowatt (gal/kW) for a particular pumping application. For example, a VFD can be started at a predetermined speed and adjusted until the optimum speed is found.

Example Implementations

Figure 1:
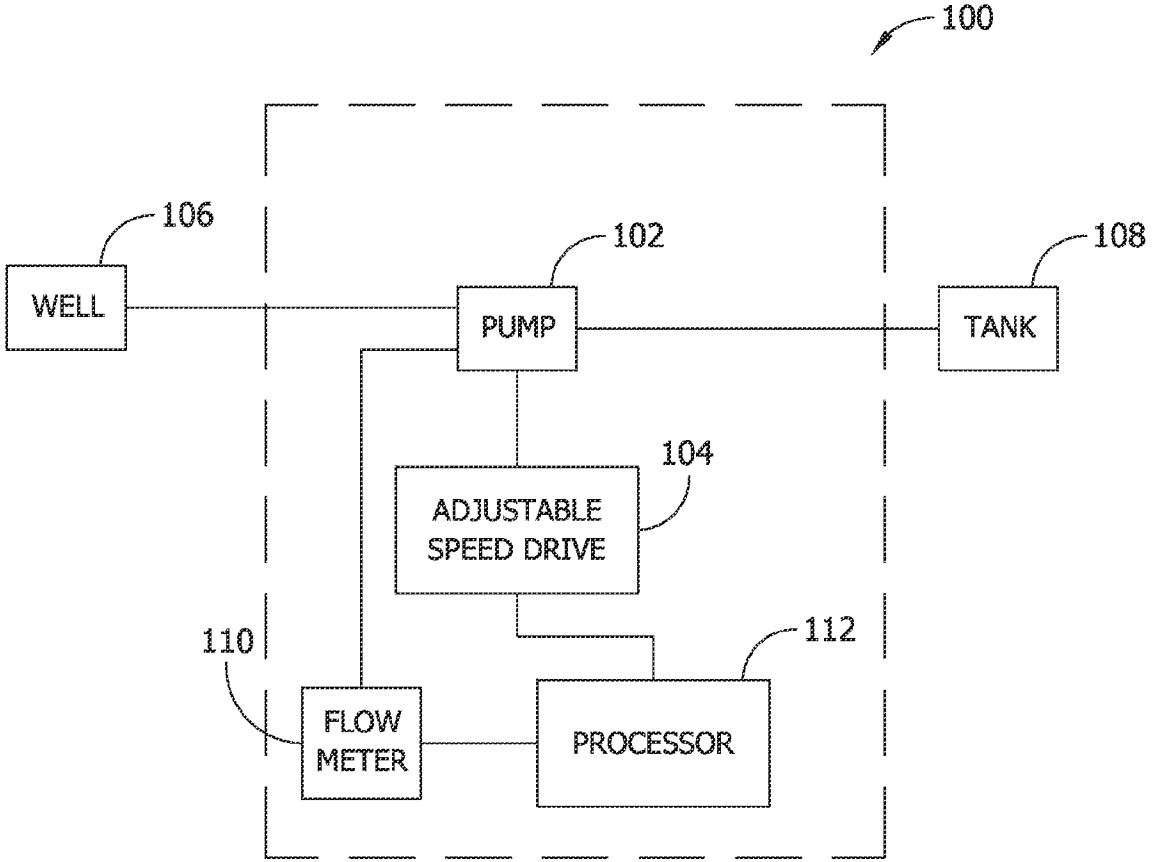
FIG. 1 is a block diagram illustrating a system for pumping fluid in accordance with an example implementation of the present disclosure.

FIG. 1 illustrates a system for pumping fluid in accordance with example implementations of the present disclosure. As shown, a system includes a pump. In some implementations, the pump may be used for connecting a fluid source to a fluid reservoir. For example, a pump may be used to connect a tank to a well. In other implementations, the pump may be used in a closed system. For example, a pump may be one of several pumps supplying a desired pressure or flow to a closed system. In implementations, a number of pumps can be operated using an optimization technique in accordance with the present disclosure, where one of the pumps matches the desired flow or pressure. The pump is operable to transport (pump) fluid from the fluid source to the fluid reservoir. Referring to FIG. 1, a system 100 is described. The system 100 includes a pump 102 driven by an adjustable-speed drive 104.

The pump 102 can be connected between a fluid source, such as a well 106, and a fluid reservoir, such as a tank 108. In implementations, the pump 102 is operable to pump water from the well 106 to the tank 108. It should be noted that well 106 and tank 108 are provided by way of example only, and are not meant to be restrictive of the present disclosure. The pump 102 may be used to pump fluid from other fluid sources to other fluid reservoirs.

In implementations, the pump 102 may be a centrifugal pump, a submersible pump, or another type of pump for pumping fluid from a fluid source to a fluid reservoir. The adjustable-speed drive 104 is configured to control the pumping rate of the pump 102. For example, the adjustable-speed drive 104 may comprise a Variable Frequency Drive (VFD) configured to control the rotational speed of an Alternating Current (AC) electric motor by controlling the frequency of electrical power supplied to the electric motor. The electric motor may be connected to a rotating impeller mounted on a shaft turned by the electric motor. By controlling the frequency of electrical power supplied to the electric motor via the VFD, the rotational speed of the electric motor and the pumping rate of the pump 102 can be controlled.

In implementations, the pump 102 and the adjustable-speed drive 104 can be provided as a single unit. For example, the pump 102 can be directly coupled to an electric motor and a VFD and constructed to be water tight for submersion within the well 106. In other implementations, the pump 102 and the adjustable-speed drive 104 can be provided separately. For instance, the pump 102 can include a pump casing and an impeller connectable to a motor via a shaft extending into the casing. A motor and a VFD can be external to the pump 102 (e.g., an external motor can be connected to the pump 102 via a shaft extending into the pump casing, where the pump casing is submersed within the well 106). It should be noted that the system 100 can include multiple motors, multiple pumps, and/or multiple pump stages. For example, one or more motors can be connected to more than one impeller and casing, where each impeller and casing comprises a pump stage.

The system 100 includes a flow meter 110 coupled with the pump 102 for determining an approximately instantaneous pumping rate of the pump 102. For example, the flow meter 110 may comprise a water flow meter for measuring water flow as pumped by the system 100 from the well 106 to the tank 108. In implementations, the flow meter 110 may be connected directly to the pump 102, or directly to an output of the pump 102. In other implementations, the flow meter 110 may be connected to a water line connecting the pump 102 to the well 106. In further implementations, the flow meter 110 may be connected to a water line connecting the pump 102 to the tank 108.

The flow meter 110 determines an approximately instantaneous (on-the-fly) pumping rate for the pump 102. Within the context of the present disclosure, "approximately instantaneous" can be used to describe a pumping rate that is a measure of bulk fluid movement with respect to a small time interval (e.g., a time interval of microseconds, milliseconds, seconds, minutes, and so forth). The approximately instantaneous pumping rate may be measured in units such as gallons per minute, or in other units describing bulk fluid movement over time. In implementations, bulk fluid movement can be measured with respect to a time interval comprising a small interval of discrete time (e.g., as measured by a clock). Also, the approximately instantaneous pumping rate can be determined as the result of a derivation performed on bulk fluid movement measurements with respect to time. It should be noted that the instantaneousness of the approximately instantaneous pumping rate may be limited by the frequency at which pumping measurements are taken.

The adjustable-speed drive 104 (or another external device for monitoring power consumption of a motor) determines an approximately instantaneous (on-the-fly) power consumption for the pump 102. Within the context of the present disclosure, "approximately instantaneous" can be used to describe power consumption that is a measure of power consumed for a small time interval (e.g., a time interval of microseconds, milliseconds, seconds, minutes, and so forth). The approximately instantaneous power consumption may be measured in units such as kilowatts (kW), or in other units describing power consumption. In implementations, power consumption can be measured for a time interval comprising a small interval of discrete time (e.g., as measured by a clock). Also, the approximately instantaneous power consumption can be determined as the result of a derivation. It should be noted that the instantaneousness of the approximately instantaneous power consumption may be limited by the frequency at which power measurements are taken.

The system 100 includes a processor 112 connected to the adjustable-speed drive 104 and the flow meter 110. In some implementations, the processor 112 is included with the adjustable-speed drive 104. In other implementations, the processor 112 is external to the adjustable-speed drive 104. For example, in one particular implementation, the processor 112 can be implemented as a PLC integrated with the adjustable-speed drive 104. However, in other implementations, the processor 112 can be implemented with software, hardware, firmware, and so forth. Further, the processor can be remote from the adjustable-speed drive 104 and can connect to the adjustable-speed drive 104 and/or the flow meter 110 via a remote connection, such as a network connection provided via the Internet, an intranet, an Ethernet, or another type of network for connecting remote devices.

The processor 112 is configured to receive approximately instantaneous pumping rate measurements from the flow meter 110 and approximately instantaneous power consumption measurements, which may be received from the adjustable-speed drive 104 or from another external device for monitoring power consumption of a motor. The processor 112 includes control programming configured to associate approximately instantaneous pumping rates and approximately instantaneous power consumptions with the time intervals for which the pumping and power measurements were taken. Then, the processor 112 is configured to calculate metrics for determining an optimal speed at which to operate the pump 102. For example, the control programming may be configured to compare a first metric representing an approximately instantaneous pumping rate and an approximately instantaneous power consumption for a first time interval to a second metric representing an approximately instantaneous pumping rate and an approximately instantaneous power consumption for a second time interval. In a specific instance, the first metric can be expressed as a ratio of pumping rate (e.g., in gallons per minute) divided by power consumption (e.g., in kilowatts). Then, the processor 110 can search for an optimal pumping rate based upon the two metrics.

In one implementation, an optimization solution has been implemented on a Bristol Babcock ControlWave hybrid Remote Terminal Unit (RTU). The RTU communicates directly to a VFD via RS485 serial communications using a Modbus protocol to retrieve instantaneous kilowatt usage of the VFD/pump. A flow meter is used that outputs a signal in the range of between four and twenty milliamps (4-20 mA) that is also received by the RTU to give an instantaneous flow rate in gallons per minute.

The RTU divides the flow rate by the power usage to get a value for instantaneous gallons per kilowatt (gal/kW). The RTU also controls the speed of the VFD. This is done using an output to the drive of between four and twenty milliamps (4-20 mA). However, in other implementations, controlling the speed of the VFD can also be done via the communication link.

In this implementation, control logic can be implemented that works in the following manner: When the pump is started, it is given a preset speed command (e.g., approximately 90%) of full speed. After the pump is run for a short period of time after startup (e.g., between two and three minutes) to allow for stabilization, and the gallons per kilowatt (gal/kW) value is recorded, the speed of the pump is adjusted down by a preset amount (e.g., 5%). There is a thirty (30) second stabilization delay, and then the current gallons per kilowatt (gal/kW) value is compared to the one that was stored from the previous speed. The control programming determines if the gallons per kilowatt (gal/kW) value at the new speed is greater than or less than the stored value. The difference of the previous gallons per kilowatt (gal/kW) reading and the current gallons per kilowatt (gal/kW) is also determined. A comparator function is used to determine the direction of the next move and a percentage of the difference is used for the value of the next move. As the pump approaches optimization, the speed adjustments will become less and less. When the optimum speed is overshot, the RTU will reverse the direction of adjustments. The RTU will make adjustments up and down to the speed every thirty (30) seconds. As the speed gets to the optimum speed, these adjustments are very small (because the difference in gallons per kilowatt (gal/kW) is very small), so once the optimum speed is found these speed adjustments are minute. The next time the pump is started it will go to the last speed and start making adjustments from there.

In another implementation, when the pump starts for the first time, the pump will run at full speed (e.g., 60 Hz) for a couple of minutes to let everything stabilize. A gallon per kilowatt (gal/kW) reading is calculated and stored as "reading 1." The next step is to slow the pump down (e.g., to 55 Hz). After a delay period of one minute, a second gallon per kilowatt (gal/kW) reading, "reading 2," is compared to "reading 1." A comparator function is used to compare the two readings. The comparator function outputs the difference between the two readings, as well as an indication as to whether "reading 1" is greater than or less than "reading 2." A second comparator function is used to compare the two speeds (e.g., 60 Hz and 55 Hz). The output used for the second comparator function is the greater than or less than output. The program uses a multiplier along with the difference between the two gallons per kilowatt (gal/kW) readings to determine the magnitude of the next adjustment. It also uses the greater than/less than outputs of both comparators to determine the direction of the next move. The current gallon per kilowatt (gal/kW) reading and current speed are stored. The speed is adjusted, and a delay period is started before a new gallon per kilowatt (gal/kW) reading is taken. The process is run continually. As the speed of the pump approaches the optimum speed, the difference between the gallons per kilowatt (gal/kW) readings becomes smaller and so does the amount in which the speed is adjusted. A minimum speed adjustment is used so the pump speed changes a little every time through the sequence. This is done so the pump will always remain as close to the optimum speed as possible as other parameters change. When the pump is shut down, it comes back up to the last speed it had been running and the process resumes.

For an example pseudo code description of an implementation in accordance with the present disclosure, the following parameters are used:

GPKW1=Gallons per kilowatt stored reading
GPKW2=Gallons per kilowatt current reading
GPKWDIFF=GPKW1−GPKW2
GPKW_BOOL=Greater than/less than: this signal is a 1 if GWKW2>GPKW1, or 0 if GWKW2<GPKW1
VFD_SPEED_OUT=Speed command to VFD
SPEED1=VFD stored speed
SPEED2=VFD current speed
SPEED_BOOL=Greater than/less than: this signal is a 1 if SPEED2>SPEED1, or 0 if SPEED2<SPEED1

The following is an example pseudo code description of an implementation in accordance with the present disclosure:

Record GPKW1 and SPEED1
Wait for delay period to expire
Compare GPKW2 and GPKW1
Compare SPEED2 and SPEED1
If GPKW_BOOL=1 and SPEED_BOOL=0 or GPKW_BOOL=0 and SPEED_BOOL=1 then adjust the speed down
If GPKW_BOOL=0 and SPEED_BOOL=0 or GPKW_BOOL=1 and SPEED_BOOL=1 then adjust the speed up
The amount of the speed adjustment is =GPKWDIFF*MULTIPLIER or the minimum speed adjustment, whichever is greater
Move GPKW2 to GPKW1 and move SPEED2 to SPEED1
Start over It should be noted that the above-described techniques can be modified to allow for smoother transitions while the pump and associated control circuitry work to find an optimal speed. This may include averaging the flow and/or using a sliding multiplier.

Figure 2:
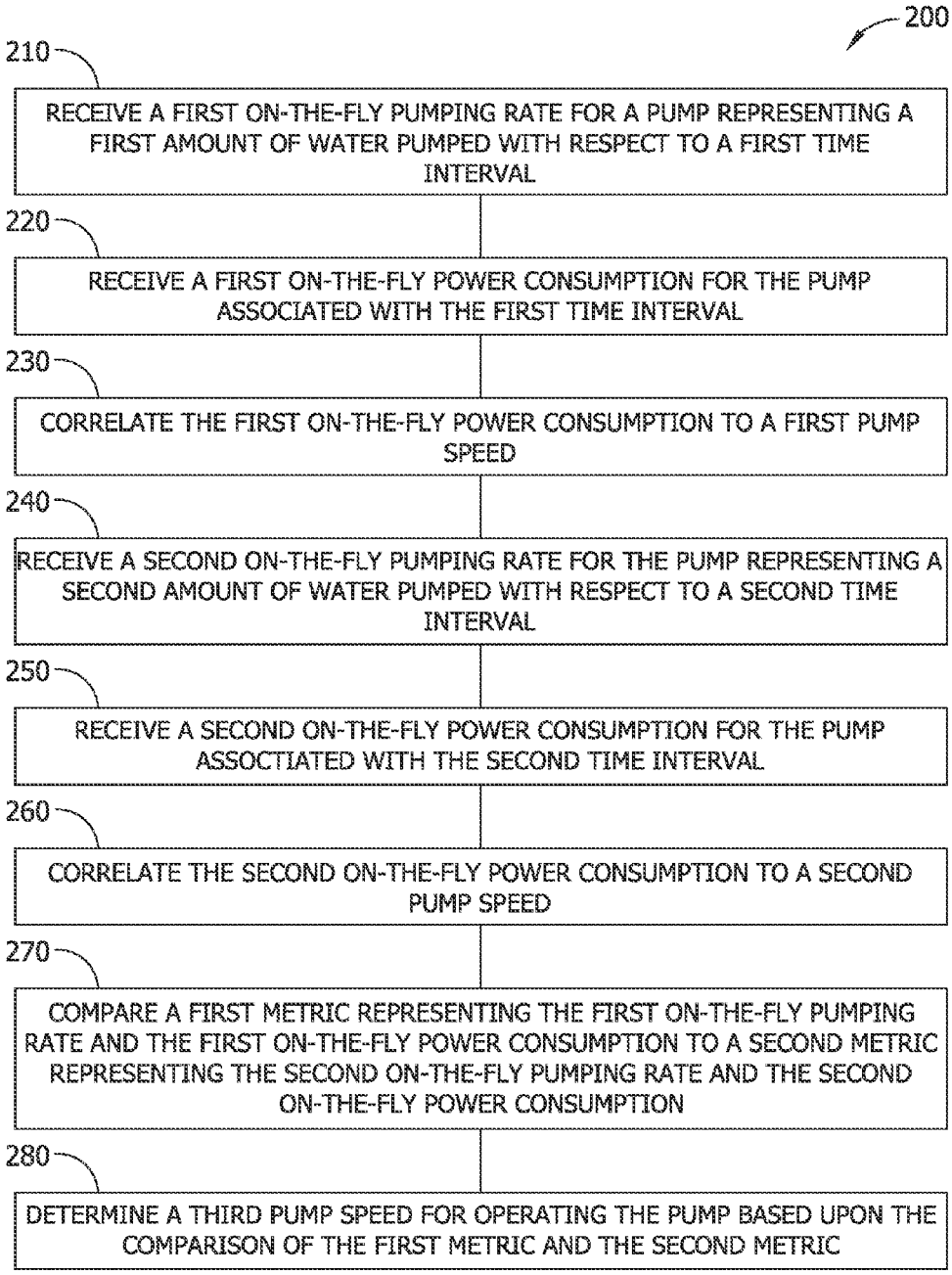
FIG. 2 is a flow diagram illustrating a method for controlling a pump in accordance with an example implementation of the present disclosure.

FIG. 2 depicts a method 200, in an example implementation, for optimizing power consumption for an adjustable-speed pump, such as a pump 102 included with a system 100 illustrated in FIG. 1 and described above. In the method 200 illustrated, a first on-the-fly pumping rate for a pump representing a first amount of fluid (e.g., water) pumped with respect to a first time interval is received (Block 210). For example, processor 112 can receive an approximately instantaneous pumping rate from flow meter 110 for a first time interval. A first on-the-fly power consumption for the pump associated with the first time interval is received (Block 220). For example, processor 112 can receive an approximately instantaneous power consumption from adjustable-speed drive 104 for the first time interval. The first on-the-fly power consumption is correlated to a first pump speed (Block 230). For example, processor 112 can correlate the approximately instantaneous power consumption for the first time interval to a pump speed for the first time interval.

A second on-the-fly pumping rate for the pump representing a second amount of fluid (e.g., water) pumped with respect to a second time interval is received (Block 240). For example, processor 112 can receive another approximately instantaneous pumping rate from flow meter 110 for a second time interval. A second on-the-fly power consumption for the pump associated with the second time interval is received (Block 250). For example, processor 112 can receive another approximately instantaneous power consumption from adjustable-speed drive 104 for the second time interval. The second on-the-fly power consumption is correlated to a second pump speed (Block 260). For example, processor 112 can correlate the approximately instantaneous power consumption for the second time interval to a pump speed for the second time interval.

A first metric representing the first on-the-fly pumping rate and the first on-the-fly power consumption is compared to a second metric representing the second on-the-fly pumping rate and the second on-the-fly power consumption (Block 270). For example, the approximately instantaneous pumping rate divided by the approximately instantaneous power consumption for the first time interval can be compared to the approximately instantaneous pumping rate divided by the approximately instantaneous power consumption for the second time interval. A third pump speed is determined for operating the pump based upon the comparison of the first metric and the second metric (Block 280). For example, a speed for operating the pump may be selected as described previously. These steps may be repeated while the system searches for an optimal speed for the pump.

CONCLUSION

Although a few exemplary implementations of the present disclosure have been shown and described, the present disclosure is not limited to the described exemplary implementations. Instead, changes may be made to these exemplary implementations without departing from the principles and spirit of the disclosure, the scope of which is defined by the claims and their equivalents.

The terminology used in the description of the disclosure herein is for the purpose of describing particular implementations only and is not intended to be limiting of the disclosure. As used in the description of the implementations of the disclosure and the appended claims, the singular forms "a," "an," and "the" are intended to include the plural forms as well, unless the context clearly indicates otherwise.

Unless otherwise defined, all technical and scientific terms used herein have the same meaning as commonly understood by one of ordinary skill in the art to which this disclosure belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers, and/or sections, these features, elements, regions, layers, and/or sections should not be limited by these terms. These terms are only used to distinguish one feature, element, region, layer, or section from another feature, element, region, layer, or section. Thus, a first feature, element, region, layer, or section discussed below could be termed a second feature, element, region, layer, or section, and similarly, a second without departing from the teachings of the present disclosure.

It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Further, as used herein the term "plurality" refers to at least two elements. Additionally, like numbers refer to like elements throughout.

Thus, there has been shown and described several implementations of a disclosure. As is evident from the foregoing description, certain aspects of the present disclosure are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the disclosure are deemed to be covered by the disclosure which is limited only by the claims which follow. The scope of the disclosure is not intended to be limited to the implementations shown herein, but is to be accorded the full scope consistent with the claims, wherein reference to an element in the singular is not intended to mean "one and only one" unless specifically so stated, but rather "one or more." All structural and functional equivalents to the elements of the various implementations described throughout this disclosure that are known or later come to be known are expressly incorporated herein by reference and are intended to be encompassed by the claims.

What is claimed is:

1. A system comprising:

a pump for connecting to a fluid source for transporting fluid;

an adjustable-speed drive coupled with the pump for driving the pump at a plurality of pumping rates;

a flow meter coupled with the pump for determining an approximately instantaneous pumping rate of the pump;

a processor coupled with the adjustable-speed drive and the flow meter for receiving an approximately instantaneous power consumption and an approximately instantaneous pumping rate, the processor configured to control the adjustable speed drive to selectively operate the pump at a pumping rate selected from the plurality of pumping rates; and control programming configured to associate a first approximately instantaneous pumping rate with a first approximately instantaneous power consumption for a first time interval, and to associate a second approximately instantaneous pumping rate with a second approximately instantaneous power consumption for a second time interval, the control programming configured to select an optimal pumping rate for operating the pump based upon the comparison of a first metric determined from the first approximately instantaneous pumping rate and the first approximately instantaneous power consumption and a second metric determined from the second approximately instantaneous pumping rate and the second approximately instantaneous power consumption; wherein the control programming is configured to start the pump at least approximately at ninety percent (90%) of full speed.

2. The system as recited in claim 1, wherein the first metric representing the first approximately instantaneous pumping rate and the first approximately instantaneous power consumption comprises the first approximately instantaneous pumping rate divided by the first approximately instantaneous power consumption.

3. The system as recited in claim 1, wherein the fluid source comprises a well, and the pump connects the well to a tank for storing water pumped from the well.

4. The system as recited in claim 1, wherein the fluid source and the pump comprise a closed system.

5. The system as recited in claim 1, wherein a pump speed for the second time interval is at least approximately five percent (5%) less than a pump speed for the first time interval.

6. The system as recited in claim 1, wherein the second approximately instantaneous pumping rate is measured between at least approximately thirty (30) seconds and one minute after the first instantaneous pumping rate.

* * * * *